US007354008B2

(12) United States Patent
Hester et al.

(10) Patent No.: US 7,354,008 B2
(45) Date of Patent: Apr. 8, 2008

(54) FLUIDIC NOZZLE FOR TRIGGER SPRAY APPLICATIONS

(75) Inventors: Russell D. Hester, Odenton, MD (US); Rosa Korobkov, Timonium, MD (US); Alan Santamarina, Columbia, MD (US); Steve Crockett, Hampstead, MD (US); Shridhar Gopalan, Westminster, MD (US)

(73) Assignee: Bowles Fluidics Corporation, Columbia, MD (US)

( * ) Notice: Subject to any disclaimer, the term of this patent is extended or adjusted under 35 U.S.C. 154(b) by 0 days.

(21) Appl. No.: 11/235,427

(22) Filed: Sep. 26, 2005

(65) Prior Publication Data

US 2006/0065765 A1 Mar. 30, 2006

Related U.S. Application Data

(60) Provisional application No. 60/612,742, filed on Sep. 24, 2004.

(51) Int. Cl.
*B05B 1/08* (2006.01)
*B05B 9/043* (2006.01)
*B05B 1/02* (2006.01)

(52) U.S. Cl. ..... 239/589.1; 239/333; 239/391; 239/392; 239/394; 239/396; 239/DIG. 3

(58) Field of Classification Search ..... 239/589.1, 239/333, 391, 392, 394, 396, DIG. 3, 11, 239/302, 329, 332, 390, 397, 436, 600; 137/834, 137/826; 222/383.1
See application file for complete search history.

(56) References Cited

U.S. PATENT DOCUMENTS 3,185,166 A 5/1965 Horton ..... 137/81.5
3,563,462 A 2/1971 Bauer ..... 239/456
3,791,584 A 2/1974 Drew et al. ..... 239/237
4,052,002 A 10/1977 Stouffer ..... 239/4
4,151,955 A 5/1979 Stouffer ..... 239/11
4,157,161 A 6/1979 Bauer ..... 239/11
4,185,777 A * 1/1980 Bauer ..... 239/394
4,231,519 A 11/1980 Bauer ..... 239/4
4,398,664 A 8/1983 Stouffer ..... 239/11
4,463,904 A 8/1984 Bray ..... 239/284
4,488,329 A * 12/1984 Lackenbach ..... 15/322
4,508,267 A 4/1985 Stouffer ..... 239/11
4,562,867 A 1/1986 Stouffer ..... 137/811
4,819,835 A 4/1989 Tasaki ..... 222/383
4,944,457 A 7/1990 Brewer ..... 239/242
5,035,361 A 7/1991 Stouffer ..... 239/589.1
5,181,660 A 1/1993 Stouffer et al. ..... 239/589.1

(Continued)

*Primary Examiner*—Kevin Shaver
*Assistant Examiner*—Darren Gorman
(74) *Attorney, Agent, or Firm*—Larry J. Guffey

(57) ABSTRACT

A fluidic nozzle, for use with a trigger spray applicator that issues a desired spray pattern of fluid droplets, and wherein the applicator has a liquid delivering orifice and an exterior surface proximate the orifice that is configured to receive a spray nozzle, includes in a first preferred embodiment a member having a front and a rear surface and a passage that extends between these surfaces. A portion of this passage is configured in the form of a fluidic circuit, and the configuration of this fluidic circuit is chosen so as to provide the desired spray pattern. Additionally, the passage's rear portion may be configured so as to allow this member to fit on that portion of the spray head which is configured to receive a spray nozzle.

6 Claims, 13 Drawing Sheets

U.S. PATENT DOCUMENTS

| | | | | |
|---|---|---|---|---|
| 5,213,269 | A | 5/1993 | Srinath et al. | 239/589.1 |
| 5,386,940 | A | 2/1995 | Berfield | 239/394 |
| 5,482,186 | A | 1/1996 | Rodden | 222/153.07 |
| 5,577,664 | A | 11/1996 | Heitzman | 239/99 |
| 5,590,837 | A | 1/1997 | Grogan | 239/478 |
| 5,636,768 | A | 6/1997 | Yamada | 222/383.1 |
| 5,716,008 | A | 2/1998 | Nottingham et al. | 239/333 |
| 5,749,525 | A | 5/1998 | Stouffer | 239/284.1 |
| 5,820,034 | A | 10/1998 | Hess | 239/589.1 |
| 5,845,845 | A | 12/1998 | Merke et al. | 239/1 |
| 5,906,317 | A | 5/1999 | Srinath | 239/284.1 |
| 5,964,377 | A | 10/1999 | Demarest et al. | 222/136 |
| 5,971,301 | A | 10/1999 | Stouffer et al. | 239/589.1 |
| 6,186,409 | B1 | 2/2001 | Srinath et al. | 239/1 |
| 6,240,945 | B1 | 6/2001 | Srinath et al. | 137/14 |
| 6,253,782 | B1 | 7/2001 | Raghu | 137/14 |
| 6,267,271 | B1 | 7/2001 | Tsuchida et al. | 222/383.1 |
| 6,360,965 | B1 | 3/2002 | Clearman | 239/222.19 |
| 6,592,057 | B1 | 7/2003 | Ericksen et al. | 239/587.1 |
| 6,708,898 | B1 * | 3/2004 | Hoffmann et al. | 239/284.2 |
| 6,719,219 | B1 | 4/2004 | Wang | 239/526 |
| 6,729,560 | B2 | 5/2004 | Foster et al. | 239/304 |
| 6,732,958 | B2 | 5/2004 | Norville et al. | 239/582.1 |
| 6,752,330 | B2 | 6/2004 | DiMaggio et al. | 239/337 |
| 6,805,164 | B2 | 10/2004 | Stouffer | 137/833 |
| 2003/0234303 | A1 | 12/2003 | Berning et al. | |

* cited by examiner (SECTION A-A)

FLUIDIC NOZZLE FOR TRIGGER SPRAY APPLICATIONS

CROSS-REFERENCE TO RELATED APPLICATION

This application claims the benefit of Provisional Patent Application No. 60/612,742, filed Sep. 24, 2004 by Russell Hester, Rosa Korobkov, Alan Santamarina and Keith Schloer. The teachings of this application are incorporated herein by reference to the extent that they do not conflict with the teaching herein.

BACKGROUND OF THE INVENTION

1. Field of the Invention

This invention relates to fluid handling processes and apparatus. More particularly, this invention relates to a fluidic nozzle for use with low-pressure, trigger spray applicators that can offer spray patterns heretofore unachievable with present applicators.

2. Description of the Related Art

Generally, a trigger dispenser of the type involved here is a relatively low-cost pump device which is held in the hand and which has a trigger operable by squeezing or pulling the fingers of the hand to pump liquid from a container and through a nozzle at the front of the dispenser. See FIG. 1.

Such dispensers may have a variety of features that have become common and well known in the industry. For example, the dispenser may be a dedicated sprayer that produces a defined spray pattern for the liquid as it is dispensed from the nozzle. It is also known to provide adjustable spray patterns so that with a single dispenser the user may select a spray pattern that is in the form of either a stream or a circular spray of liquid droplets.

Many substances are currently sold and marketed in containers with trigger sprayers. Examples of such substances include window cleaning solutions, carpet cleaners, spot removers, personal care products, assorted cleaning products, weed control and pest control products, and many other materials for other general spraying uses.

Such dispensers usually comprise a bottle that includes a spray head attached thereto. The spray head typically includes a manual pump that is actuated by the hand of a user to dispense the particular liquid product in a spray or stream or foam to a desired surface location or in a desired direction. The operating pressures of such manual pumps are generally in the range of 30-40 psi. The nozzles for such dispensers are typically of the one-piece molded "cap" variety, with channels corresponding to either the offered spray or stream patterns that line up with the feed channel coming out of a sprayer assembly.

Deficiencies of such applicators include: (a) the relative lack of control of the spray patterns generated, (b) the frequent generation in such sprays of an appreciable number of very small diameter or fine droplets which often are conveyed into the surrounding environment and may be harmful if inhaled, and (c) a tendency of the resulting spray patterns to be such that they are prone to have areas of heavier liquid coverage which, when the targeted surface is vertically oriented, results in the sprayed liquid collecting and forming pools that have undesirable, break-out portions that stream down the sprayed surface.

Sprayer heads recently have been introduced into the marketplace which have battery operated pumps in which one has to only press the trigger once to initiate a pumping action that continues until pressure is released on the trigger.

These typically operate at lower pressures in the range of 5-15 psi. They also suffer from the same deficiencies as noted for manual pumps; plus, appear to have even less variety in or control of the spray patterns that can be generated due to their lower operating pressures.

Despite much prior art relating to trigger spray applicators, there still exists a need for further technological improvements in the ability of such applicators to control their spray patterns, especially for those applicators that employ the lower-operating pressure, battery powered pumps.

3. Objects and Advantages

There has been summarized above, rather broadly, the prior art that is related to the present invention in order that the context of the present invention may be better understood and appreciated. In this regard, it is instructive to also consider the objects and advantages of the present invention.

It is an object of the present invention to provide new, improved nozzles for trigger spray applicators that offer more variety in and control of the spray patterns that can be generated by such applicators.

It is another object of the present invention to provide new and improved nozzles for trigger spray applicators of the type that employ battery-operated pumps.

It is yet another object of the present invention to provide new and improved nozzles for trigger spray applicators that can reduce the percentage of fine droplets generated in the sprays of such applicators.

It is also an object of the present invention to provide a means for reducing the "streaming" problems which result when present trigger spray applicators are sprayed onto vertical surfaces.

It is another object of the present invention to introduce the use of fluidic inserts and fluidic oscillators into trigger spray applications.

These and other objects and advantages of the present invention will become readily apparent as the invention is better understood by reference to the accompanying summary, drawings and the detailed description that follows.

SUMMARY OF THE INVENTION

Recognizing the need for the development of improved nozzles for trigger spray applicators, the present invention is generally directed to satisfying the needs set forth above and overcoming the disadvantages identified with prior art devices and methods.

In accordance with the present invention, a fluidic nozzle, for use with a trigger spray applicator that issues a desired spray pattern of fluid droplets, and wherein the applicator has a liquid delivering orifice and an exterior surface proximate the orifice that is configured to receive a spray nozzle, includes in a first preferred embodiment a member having a front and a rear surface and a passage that extends between these surfaces, wherein a portion of this passage is configured in the form of a fluidic circuit, and the configuration of this fluidic circuit is chosen so as to provide the desired spray pattern. Additionally, the passage's rear portion may be configured so as to allow this member to fit on that portion of the spray head which is configured to receive a spray nozzle.

In a second preferred embodiment, an upstream portion of this fluidic nozzle's passage may include an expansion section portion which has an orifice that connects this expansion section with the surrounding environment so as to allow a liquid flowing through this passage to entrain the gaseous environment surrounding the member into the passage. When the liquid is a soap-like solution, it is found that a foam is generated that can effectively be sprayed by such a fluidic nozzle.

In a third preferred embodiment, it proves useful to construct this member as two distinct parts. The front portion of this member becomes a fluidic insert which has a fluidic circuit molded into its passage. The rear portion of this member becomes a housing whose front face has a cavity into which the fluidic insert part can be fitted.

In a fourth preferred embodiment, the order of the parts mentioned in the third preferred embodiment is reversed. The front portion of the member becomes a housing having a rear cavity. The rear portion of the member becomes a fluidic insert which has a fluidic circuit molded into its passage. This fluidic insert part is then fitted into the housing's rear cavity.

Thus, there has been summarized above, rather broadly, the present invention in order that the detailed description that follows may be better understood and appreciated. There are, of course, additional features of the invention that will be described hereinafter and which will form the subject matter of the claims to this invention.

DESCRIPTION OF THE PREFERRED EMBODIMENT

Figure 1:
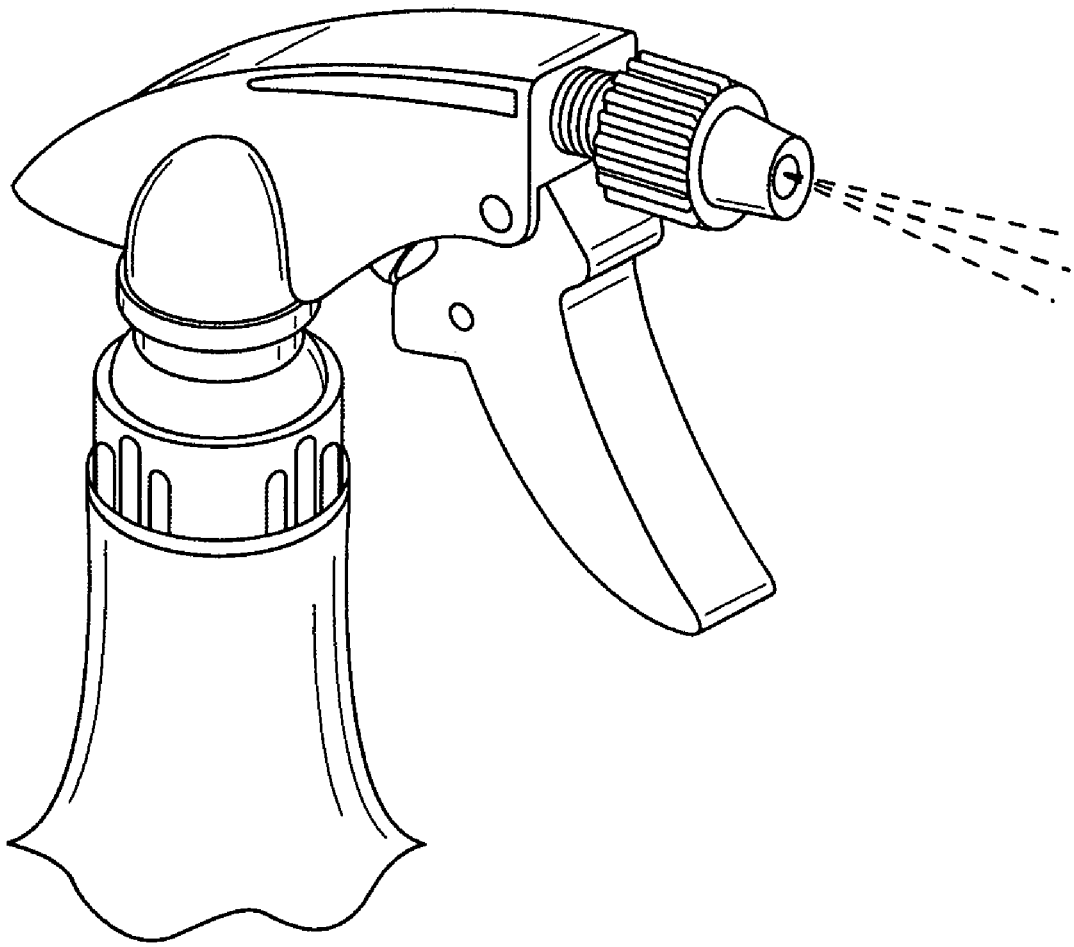
FIG. 1 (PRIOR ART)
FIG. 1 illustrates the spray head of a conventional, manual, trigger spray applicator.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways.

Also, it is to be understood that the phraseology and terminology employed herein are for the purpose of description and should not be regarded as limiting. For example, the discussion herein below generally relates to liquid spray techniques; however, it should be apparent that the inventive concepts described herein are applicable also to the dispersal of other fluids, including gases, fluidized solid particles, etc.

The present invention involves methods and apparatus for creating and controlling various spray patterns from low-pressure, battery-powered trigger spray applicators.

Figure 2A:
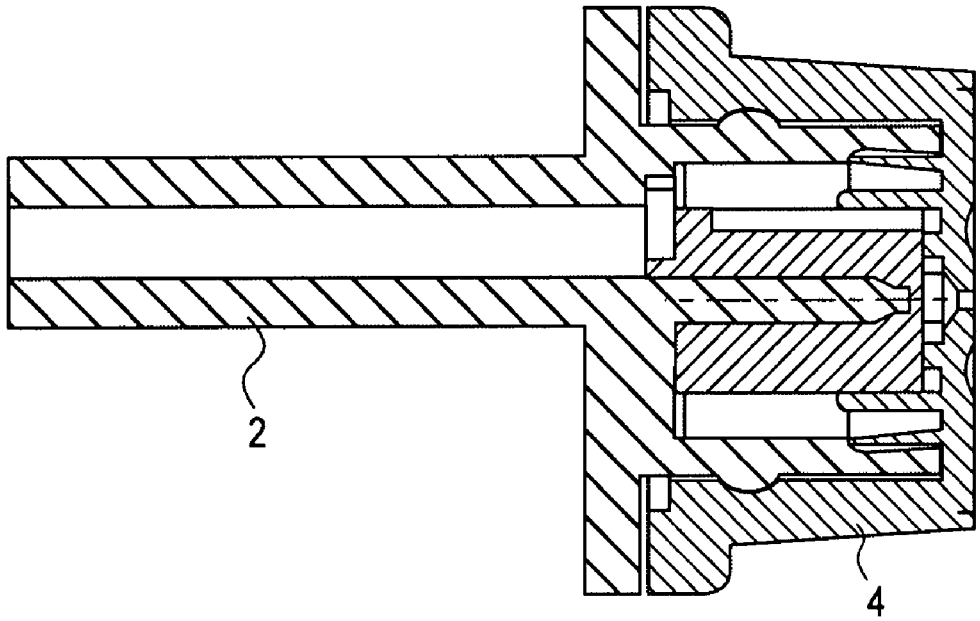
FIG. 2A (PRIOR ART)
FIG. 2A illustrates the front portion of the spray head from a typical trigger spray applicator.
Figure 2B:
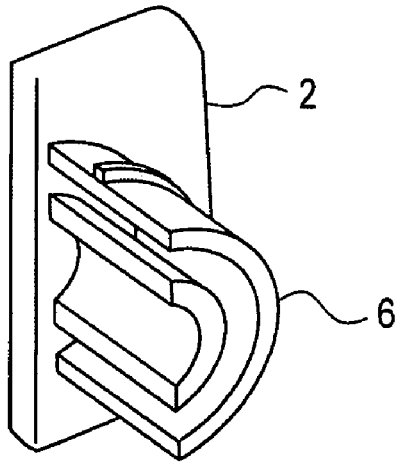
FIG. 2B (PRIOR ART)
FIG. 2B provides more details of the construction of the front portion of FIG. 3 in the form of a cut-away, cross-sectional view of the portion.
Figure 3A:
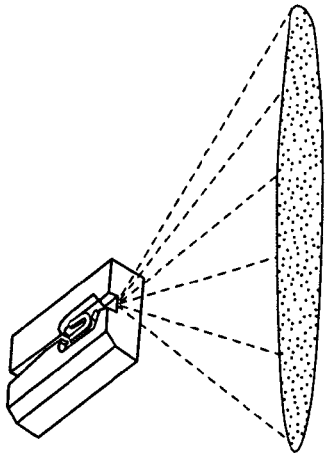
FIG. 3A (PRIOR ART)
FIGS. 3A-3F show the outlines of some of the various spray patterns that can be achieved with the use of various fluidic circuits in fluidic oscillators.
Figure 3B:
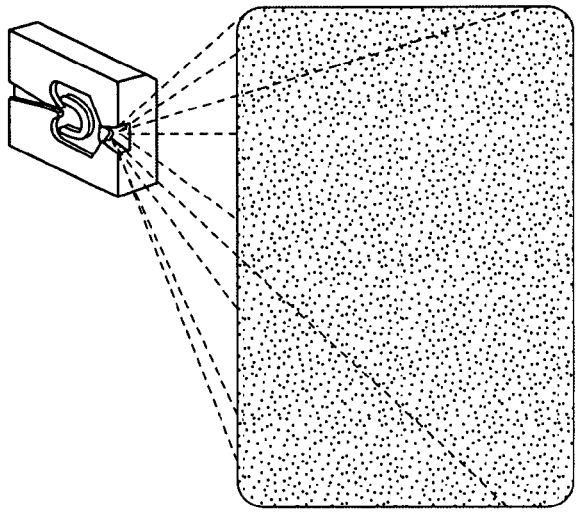
FIG. 3B (PRIOR ART)
Figure 3C:
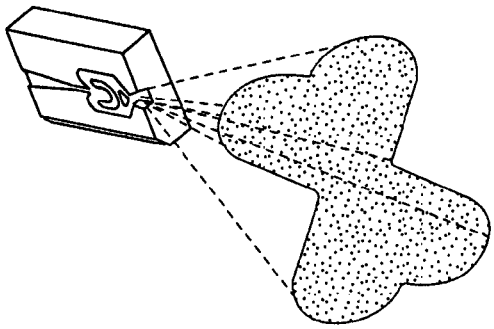
FIG. 3C (PRIOR ART)
Figure 3D:
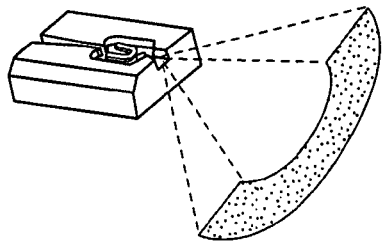
FIG. 3D (PRIOR ART)
Figure 3E:
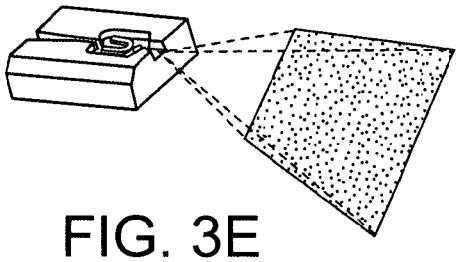
FIG. 3E (PRIOR ART)
Figure 3F:
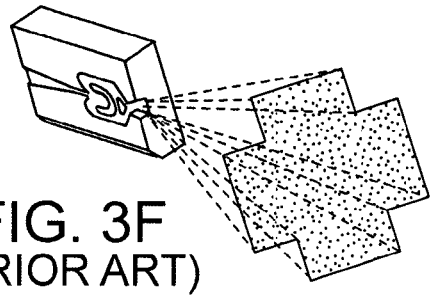
FIG. 3F (PRIOR ART)

FIG. 2A shows a cross-sectional view of the front portion of the spray head from a typical trigger spray applicator. It consists of a circular-shaped combination conduit and housing 2 that brings liquid from the pump and directs it into a nozzle 4 that is fitted on the free end of this housing. More details of the construction of this housing are shown in FIG. 2B which provides a cut-away, cross-sectional view of the housing and shows the orifice 6 from which the liquid flows. It can be noted that this spray heads uses an off-centerline orifice that proves to be useful in designing spray heads having multiple modes of operation. Spray heads having centerline orifices are also widely seen in the marketplace. The fluidic nozzle of the present invention can easily be modified so as to be compatible with either type of such spray heads.

To improve upon the performance of this trigger spray applicator, one needs to replace the current nozzle 4 with one that is compatible with the front face 2*a* or mounting surface of the current spray head's housing 2 and which also provides such a sprayer with the desired improved operating performance.

To understand how fluidic nozzles can achieve such performance improvements, it proves useful to review what we mean when we speak of "fluidic inserts or oscillators."

A "fluidic insert or oscillator" is a component part in a liquid spray device that can, without any moving parts, be designed to yield any one of a wide range of oscillating sprays (i.e., as compared to the relatively steady state flows that are emitted from standard spray nozzles) in which the liquid droplets that comprise the sprays can, by engineering of the "insert," be given desired physical properties (e.g., size of the droplets, the spatial distribution of the droplets as they pass through a plane situated normal to the centerline which marks the spray's direction of flow). See FIGS. 3A-3F for example of some of the spray distributions that are achievable with fluidic inserts.

"Fluidic inserts" are generally constructed in the form of a thin, rectangular member that is molded or fabricated from plastic and has an especially-designed liquid flow channel fabricated into either its broader top or bottom surface, and sometimes both—assuming that this fluidic insert is to be inserted into the cavity of a housing whose inner walls are configured to form a liquid-tight seal around the insert and form an outside wall for the insert's boundary surface/s which contain the especially designed flow channels. Pressurized liquid enters such an insert and is sprayed from it.

Although it is often more practical from a manufacturing standpoint to construct these inserts as thin rectangular members with flow channels in their top or bottom surfaces, it should be recognized that they can be constructed so that their especially-designed flow channels are placed practically anywhere within the member's body; in such instances the insert would have a clearly defined channel inlet and outlet.

The especially-designed liquid flow channels that are fabricated into such "inserts" are known as "fluidic circuits." Such circuits are designed to create the flow phenomena within their paths that will yield the desired spray having specified physical properties for its droplets. There are many well known designs of fluidic circuits that are suitable for use with fluidic inserts. Examples of such circuits may be found in many patents, including U.S. Pat. No. 3,185,166 (Horton & Bowles), U.S. Pat. No. 3,563,462 (Bauer), U.S. Pat. No. 4,052,002 (Stouffer & Bray), U.S. Pat. No. 4,151,955 (Stouffer), U.S. Pat. No. 4,157,161 (Bauer), U.S. Pat. No. 4,231,519 (Stouffer), which was reissued as RE 33,158, U.S. Pat. No. 4,508,267 (Stouffer), U.S. Pat. No. 5,035,361 (Stouffer), U.S. Pat. No. 5,213,269 (Srinath), U.S. Pat. No. 5,971,301 (Stouffer), U.S. Pat. No. 6,186,409 (Srinath) and U.S. Pat. No. 6,253,782 (Raghu).

Figure 4:
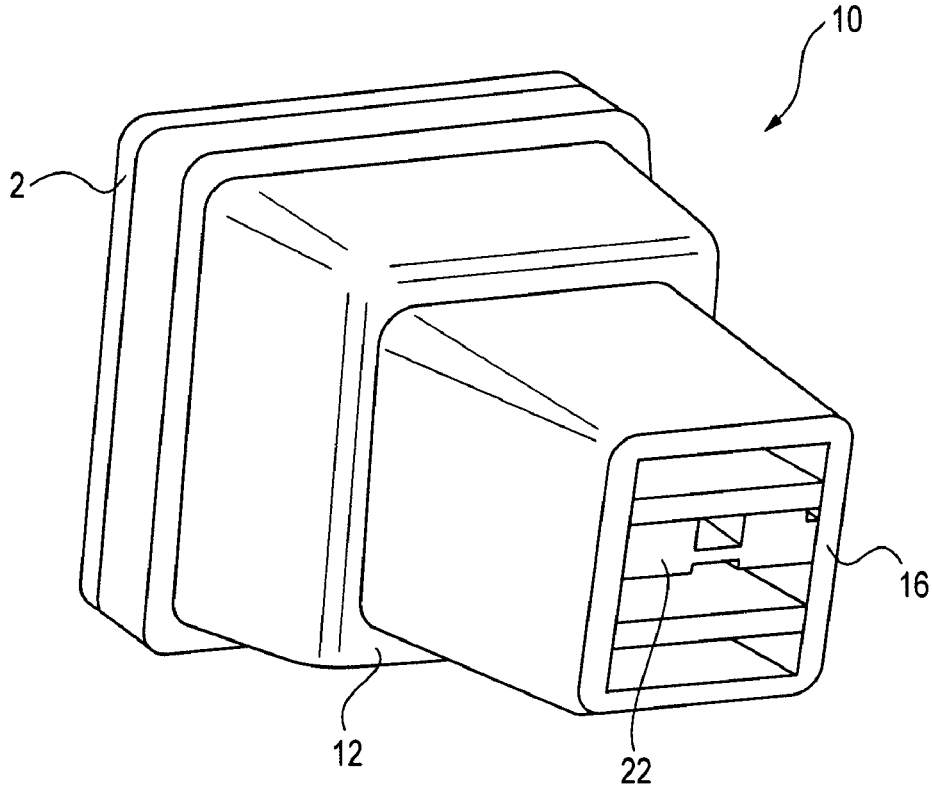
FIG. 4 shows a preferred embodiment of the present invention in the form of a nozzle assembly.

To show how such fluidic inserts can be sued to improve the performance of spray applicators, we show in FIG. 4 a first embodiment of the present in the form of a multi-mode fluidic nozzle that has been especially configured for mating with the front face 2*a* of a spray head which has an off-centerline sprayer orifice. This assembly or member 10 consists of a housing 12 which has a passage 14 that extends along its centerline between its front 16 and rear 18 surfaces.

This passage 14 is seen to have a front 14*a* and a rear 14*b* portion with a wall that effectively separates such portions. The wall has at least one orifice 15*a*. The passage's front portion 14*a* is configured into a cavity 20 that allows for the front-loading, press-fit insertion of a spray controlling, fluidic insert 22.

Figure 5:
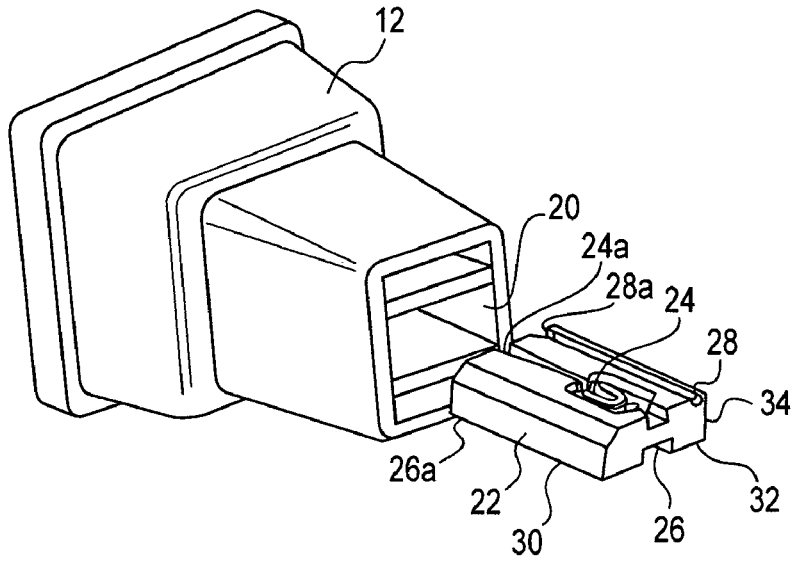
FIG. 5 provides more details for the component parts of the assembly shown in FIG. 4.
Figure 17:
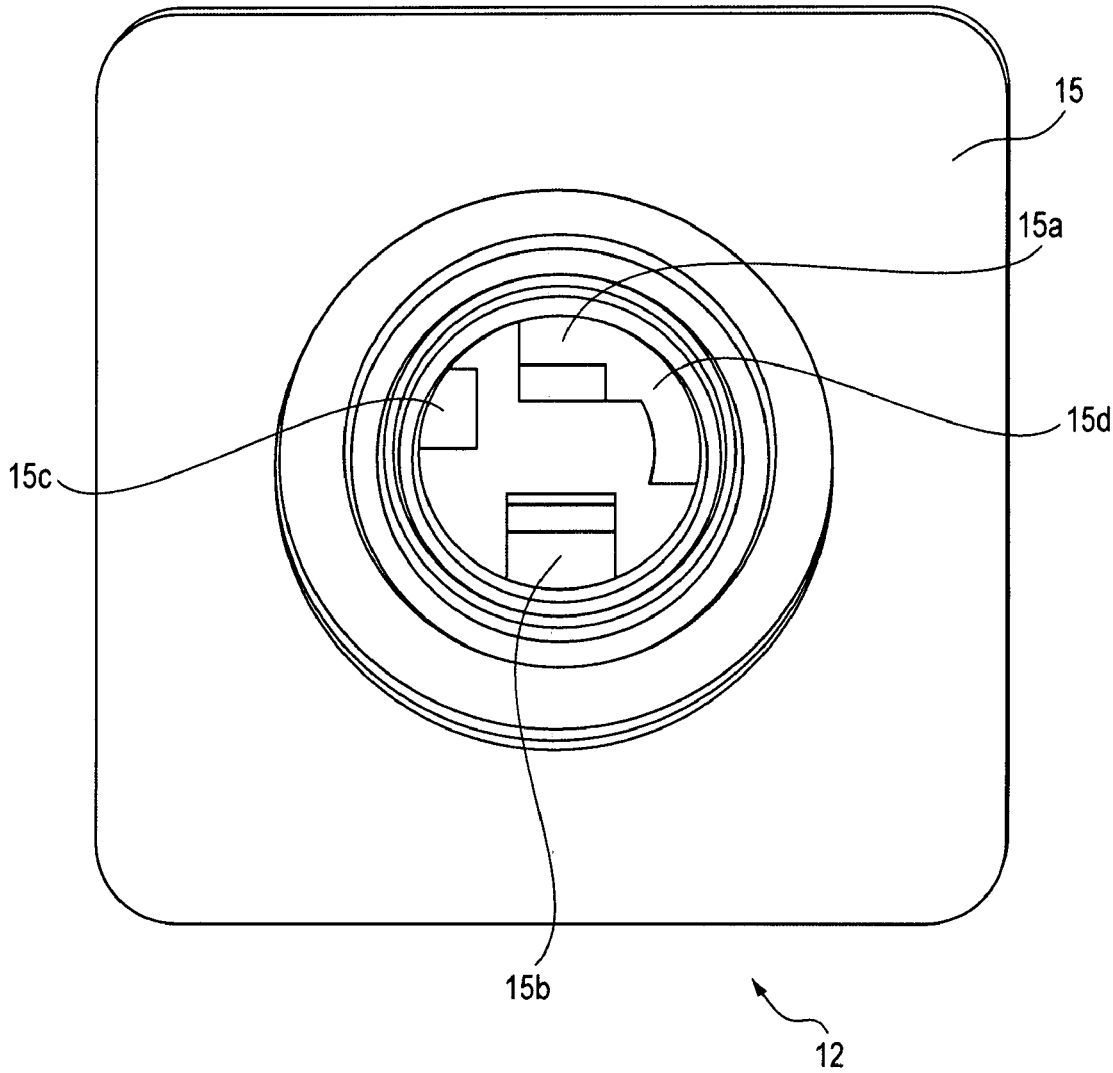
FIG. 17 illustrates how the rear surface of the housing is conformed to allow for a 90 degree change in the orientation of the two-dimensional flow from the assembly.

This situation is better shown in FIG. 5. The insert is seen to have to be rectangular in shape and to have three distinct flow paths or fluidic circuits 24, 26, 28 molded into its respect top 30, bottom 32 and the intersection of its top and right side 34 surfaces. In this instance, the housing's wall is seen to have three orifices 15*a*, 15*b*, 15*c* that align with the inlets 24*a*, 26*a*, 28*a* to the fluidic insert that is press fitted into the housing's front portion cavity 20. See FIG. 17.

Figure 6:
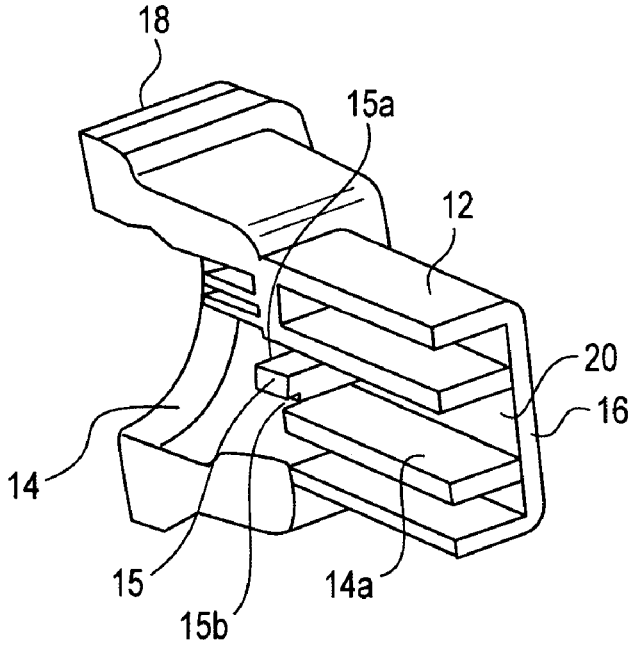
FIG. 6 shows a cut-away, cross-sectional view of the housing element of the assembly shown in FIG. 4.

These flow paths 24, 26, 28 are alternately aligned with the front housing's orifice 6 by rotating the housing 12 about the spray head housing's front face 2*a* on which it is press-fitted. FIG. 6, which shows a cut-away, cross-sectional view of the housing 12, reveals that the passage's rear portion 14*b* is configured so as to have a circular perimeter which allows for the rotation of this housing 12 about the circular cross-sectional shaped, front portion of the spay head housing 2. The fact that the orifice 6 is located off the centerline of the front housing 2 allows the insert's respective flow paths 24, 26, 28 to be alternately rotated and individually aligned with the orifice 6 so that liquid flows through only one flow path at a time.

There exist many well-known-in-the-art designs for these flow paths or fluidic circuits 24, 26, 28 so as to enable them to deliver different types of spray patterns. Most of these contain various elements (e.g., inlet, power nozzle, interaction chamber, throat, expansion section, outlet) in the paths to generate specific desired spray patterns. All of these fluidic circuit designs are considered to be within the disclosure of the present invention.

Additionally, it is recognized that such flow paths 24, 26, 28 can be molded into this insert 22 in many different, obvious ways other than that shown herein. These other obvious ways (e.g., top and bottom centered paths and one or more paths on any of the insert's four edges) are also considered to be within the scope of the disclosure for the present invention.

Figure 7:
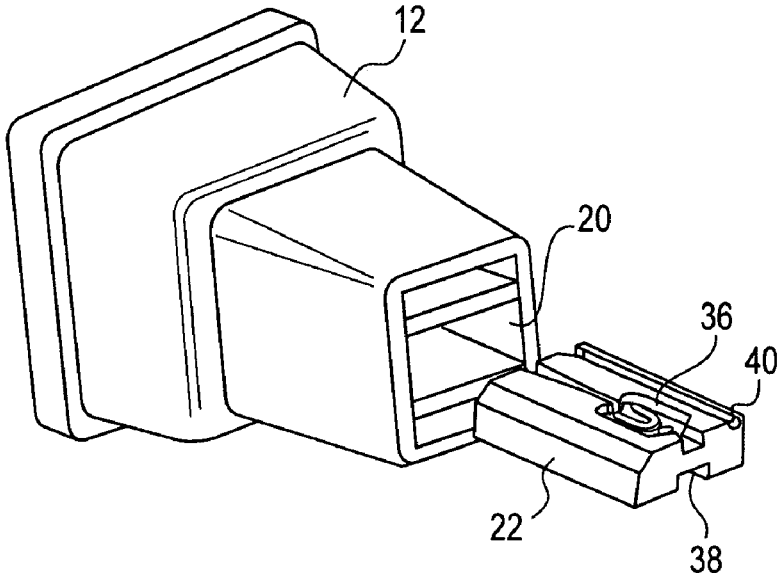
FIG. 7 shows a preferred embodiment of the present invention in which the insert of the assembly shown in FIG. 4 has been chosen to include fluidic circuits molded into the insert's top and bottom surfaces.
Figure 8:
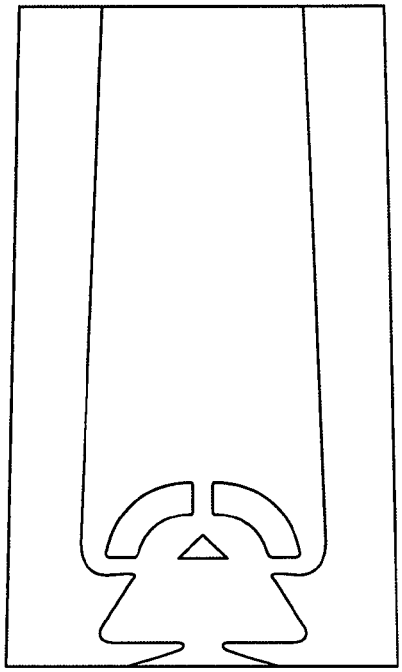
FIG. 8 illustrates the 3-Jet Island fluidic circuit which is suitable for use in the insert of FIG. 4 and which yields a two-dimensional or line spray pattern.
Figure 9:
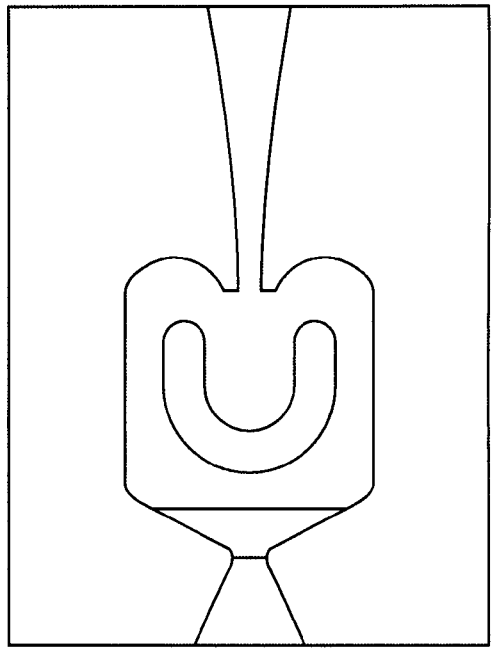
FIG. 9 illustrates the $R^2$ fluidic circuit which is suitable for use in the insert of FIG. 4 and which yields a two-dimensional or line spray pattern.
Figure 10:
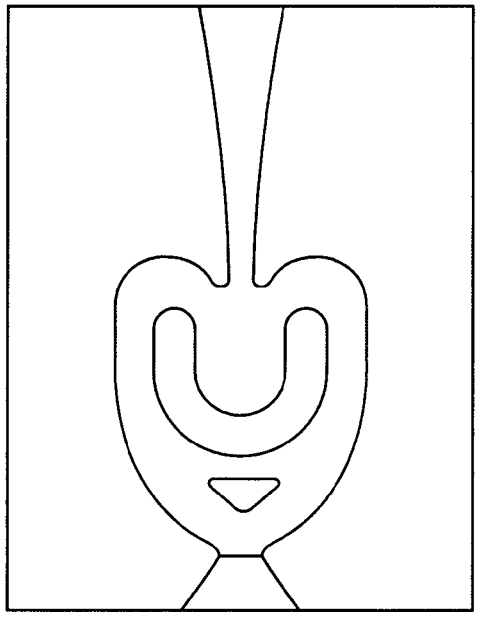
FIG. 10 illustrates the 3D fluidic circuit which is suitable for use in the insert of FIG. 4 and which yields a three-dimensional spray pattern.
Figure 11:
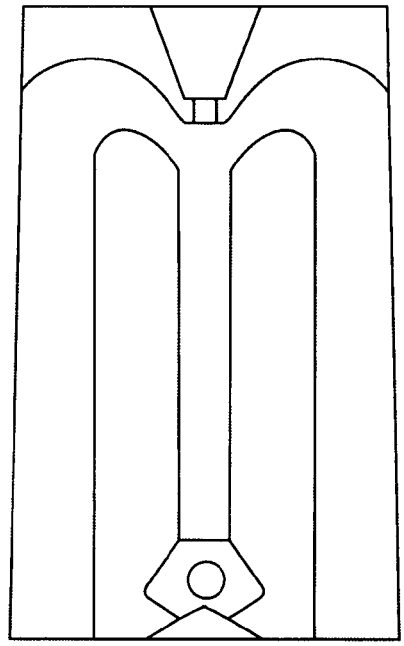
FIG. 11 illustrates the 3D Foaming fluidic circuit which is suitable for use in the insert of FIG. 4 and which yields a three-dimensional spray pattern for a foam.

FIG. 7 shows this first embodiment of the present invention in a form that has differing fluidic circuits 36, 38 molded into the insert's top 30 and bottom 32 surfaces. A slotted path 40 on this insert's top-right edge provides yet another route for liquid to flow through this insert.

Some of the fluidic circuits that have been found to be most effective in this first embodiment are shown from a top-view perspective in FIG. 8-11. These preferred circuits are denoted, respectively, as: a 3-Jet Island oscillator which yields essentially a two-dimensional or line spray pattern (see FIG. 3A), an $R^2$ oscillator which yields a similar two-dimensional spray pattern, a 3D oscillator which essentially yields a full three-dimensional spray pattern (see FIG. 3B), and a 3D Foaming oscillator which yields a three-dimensional spray distribution for a foam.

Figure 12:
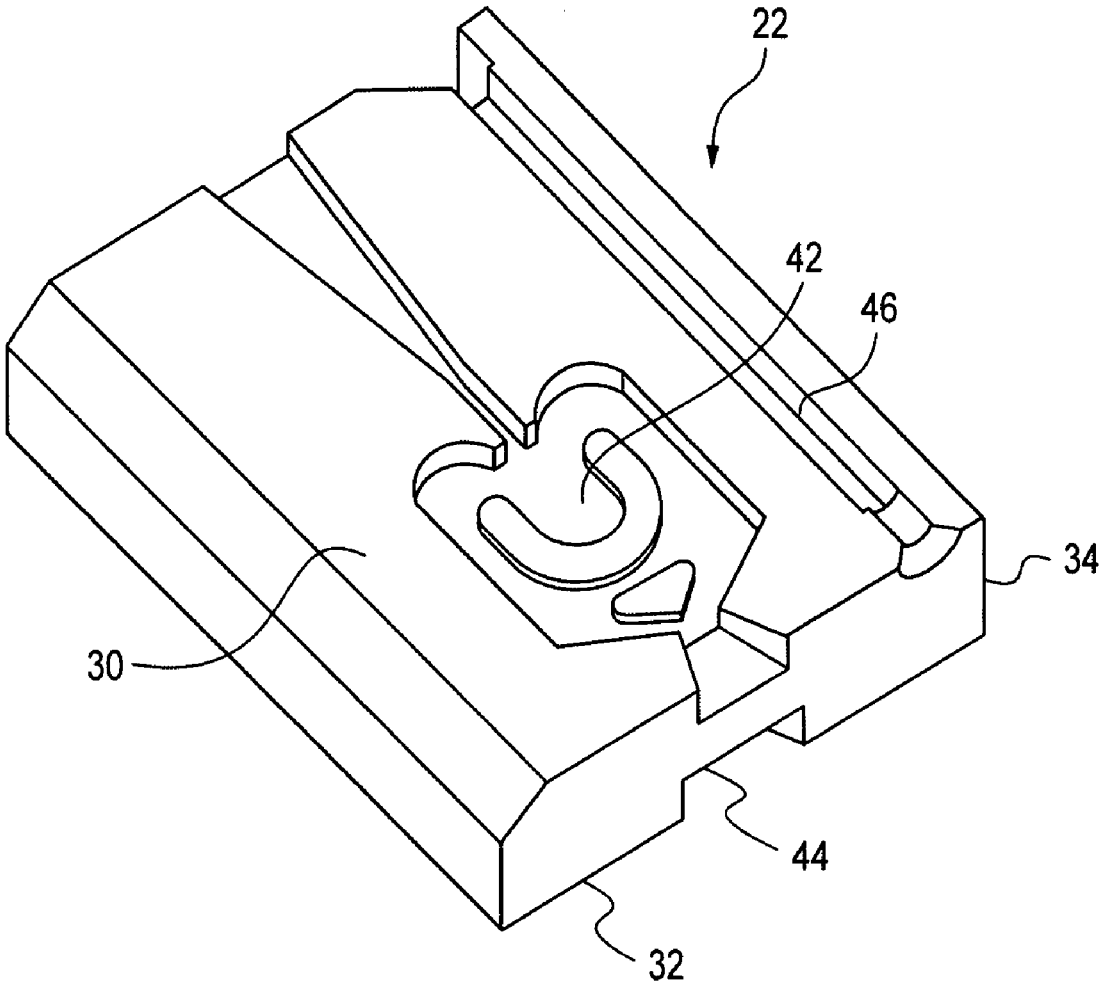
FIG. 12 shows a preferred embodiment of the present invention in the form of an insert that has a fluidic circuit molded into its top and bottom surfaces and another flow path situated proximate one of the edges of the insert.

FIG. 12 shows a preferred form of a fluidic insert 22 that is suitable for use in this first embodiment. This insert is seen to have molded into its top surface the 3D fluidic circuit 42 shown in FIG. 10. In its bottom surface is molded the $R^2$ fluidic circuit 44 shown in FIG. 9. Near its top right edge is a flow path 46 that provides for a streaming flow from the insert.

To see how such an insert 22 in conjunction with the housing 12 of the present invention can yield a variety of spray patterns, see FIG. 13-16.

Figure 13:
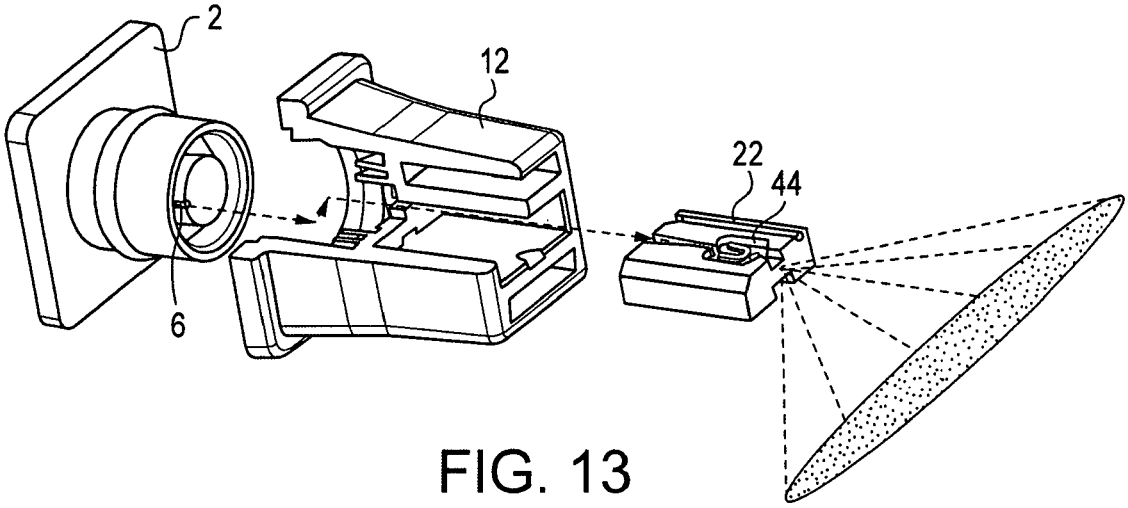
FIG. 13 illustrates how liquid flows from the orifice of a spray head's front housing and through the present invention's housing and the $R^2$ fluidic circuit of the insert so as to yield a horizontal, two-dimensional spray pattern.
Figure 14:
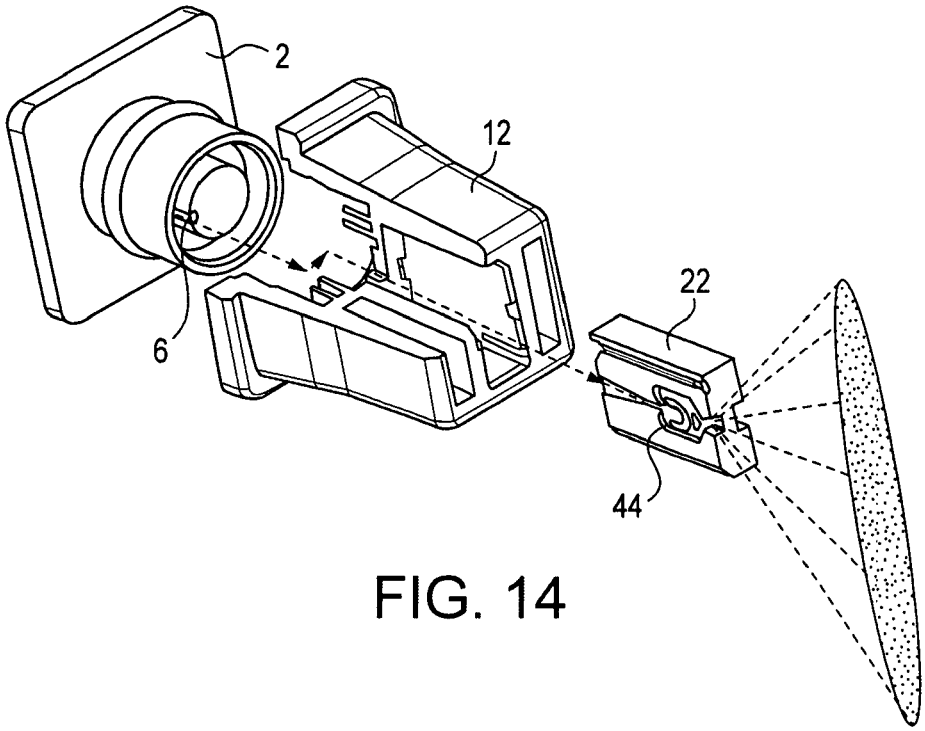
FIG. 14 illustrates how liquid flows from the orifice of a spray head's front housing and through the present invention's housing and the $R^2$ fluidic circuit of the insert so as to yield a vertical, two-dimensional spray pattern.
Figure 15:
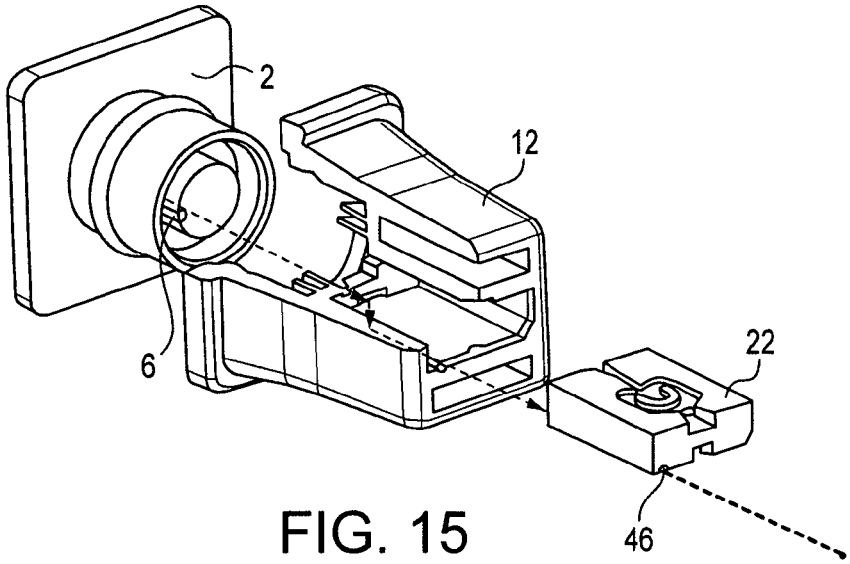
FIG. 15 illustrates how liquid flows from the orifice of a spray head's front housing and through the present invention's housing and its edge-proximate path so as to yield a stream of liquid that exits the assembly.
Figure 16:
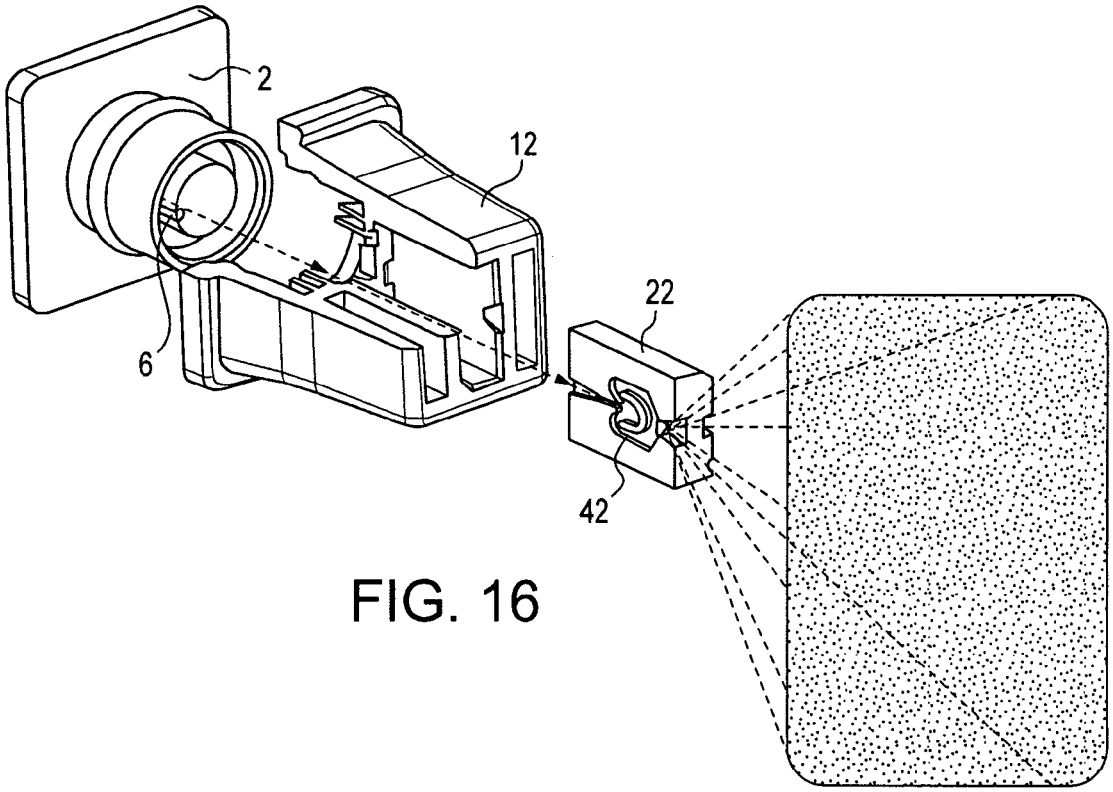
FIG. 16 illustrates how liquid flows from the orifice of a spray head's front housing and through the present invention's housing and the 3D fluidic circuit of the insert so as to yield a fully three-dimensional spray pattern.

FIG. 13 illustrates how liquid flows from the orifice 6 of a spray head's front housing 2 and through the present invention's housing 12 and the $R^2$ fluidic circuit 44 of the insert 22 to yield a horizontal, two-dimensional spray pattern.

Rotating this assembly 90 degrees clockwise keeps this flow path aligned the spray head's orifice so as to yield a vertical, two-dimensional spray pattern. See FIG. 14. To allow for this rotation, the rear surface of the housing's wall 15 is configured with a groove 15*d* that is configured in the form of a 90 degree arc portion of the path defined by the rotation of the housing. One of the wall openings 15*a* lies in the bottom of this groove. See FIG. 17.

A further 90 degree rotation of the housing 12 aligns the insert's flow path 46 with the 3D fluidic circuit 42 with the orifice 6 so as to yield a stream of liquid that exits from the assembly. See FIG. 15.

Another 90 degree rotation of the housing 12 aligns the insert's 3D fluidic circuit 42 with the orifice 6 so as to yield a fully three-dimensional spray pattern. See FIG. 16.

Figure 18A:
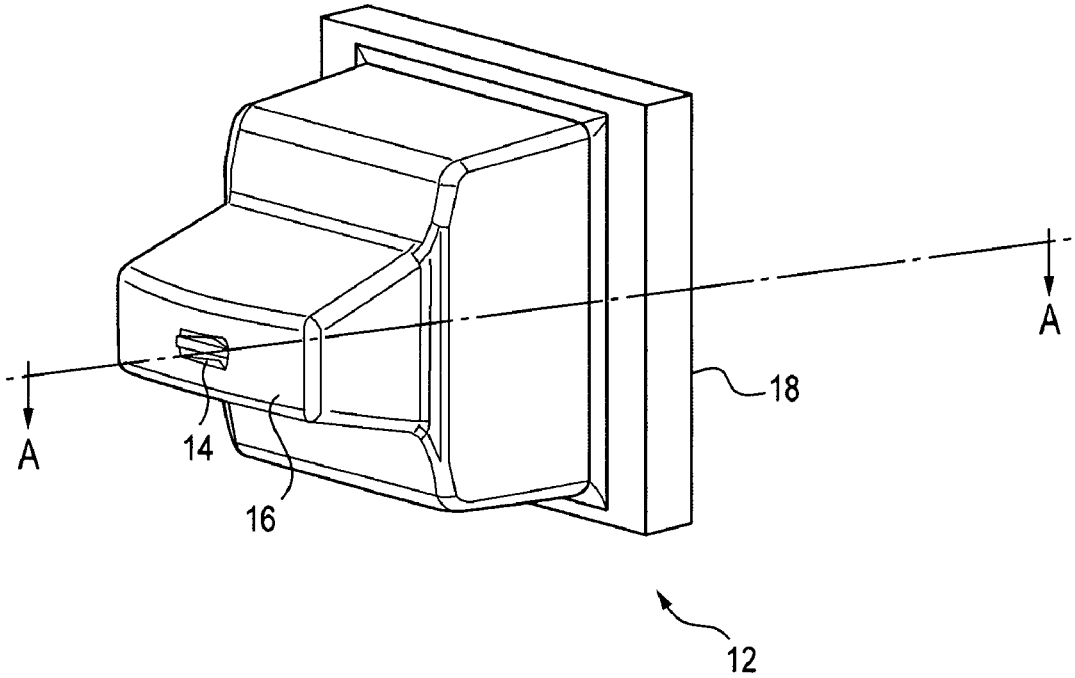
FIGS. 18A and 18B show a perspective view and a cross-sectional view of a fluidic nozzle that provides for only a single mode of spray operation.
Figure 18B:
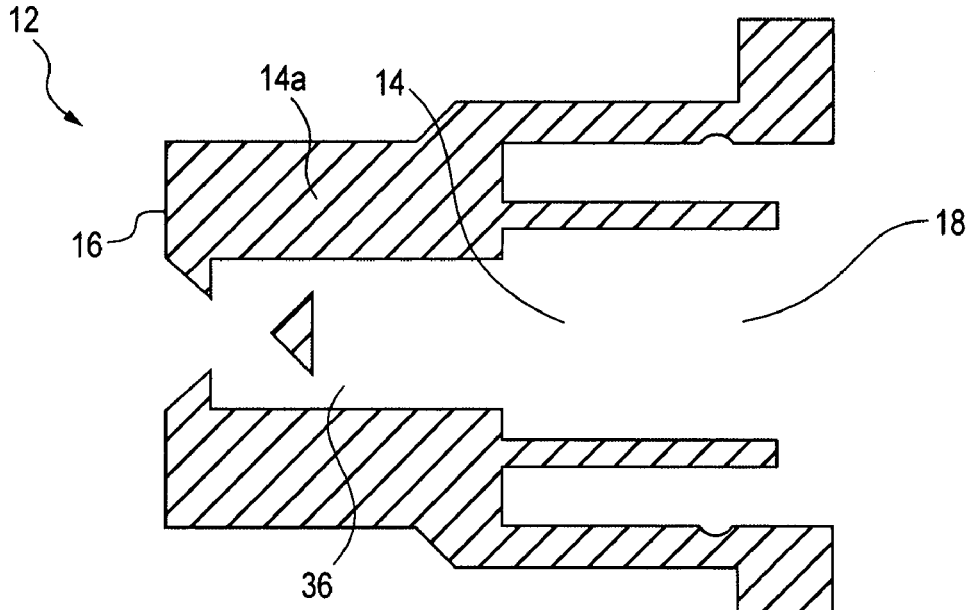

FIGS. 18A and 18B show a perspective view and a cross-sectional view of a second preferred embodiment of the present invention. This embodiment takes the form of a fluidic nozzle that is of a simpler construction and which provides for only a single mode of operation. In this instance a fluidic circuit 36 had been molded directly into the front portion 14*a* of the housing's passage 14. See FIG. 18B. The rear face 18 of this housing/nozzle and/or the rear portion of its passage has been especially configured for mating with the front face 2*a* of the spray head onto which it is to be fitted. This fluidic nozzle provides the final conditioning of the flow of liquid through the nozzle so as to impart the spray's desired characteristics. Depending on the fluidic circuit chosen, different characteristics can be imparted to the spray's dispersion pattern, droplet sizes, velocity, etc.

Figure 19:
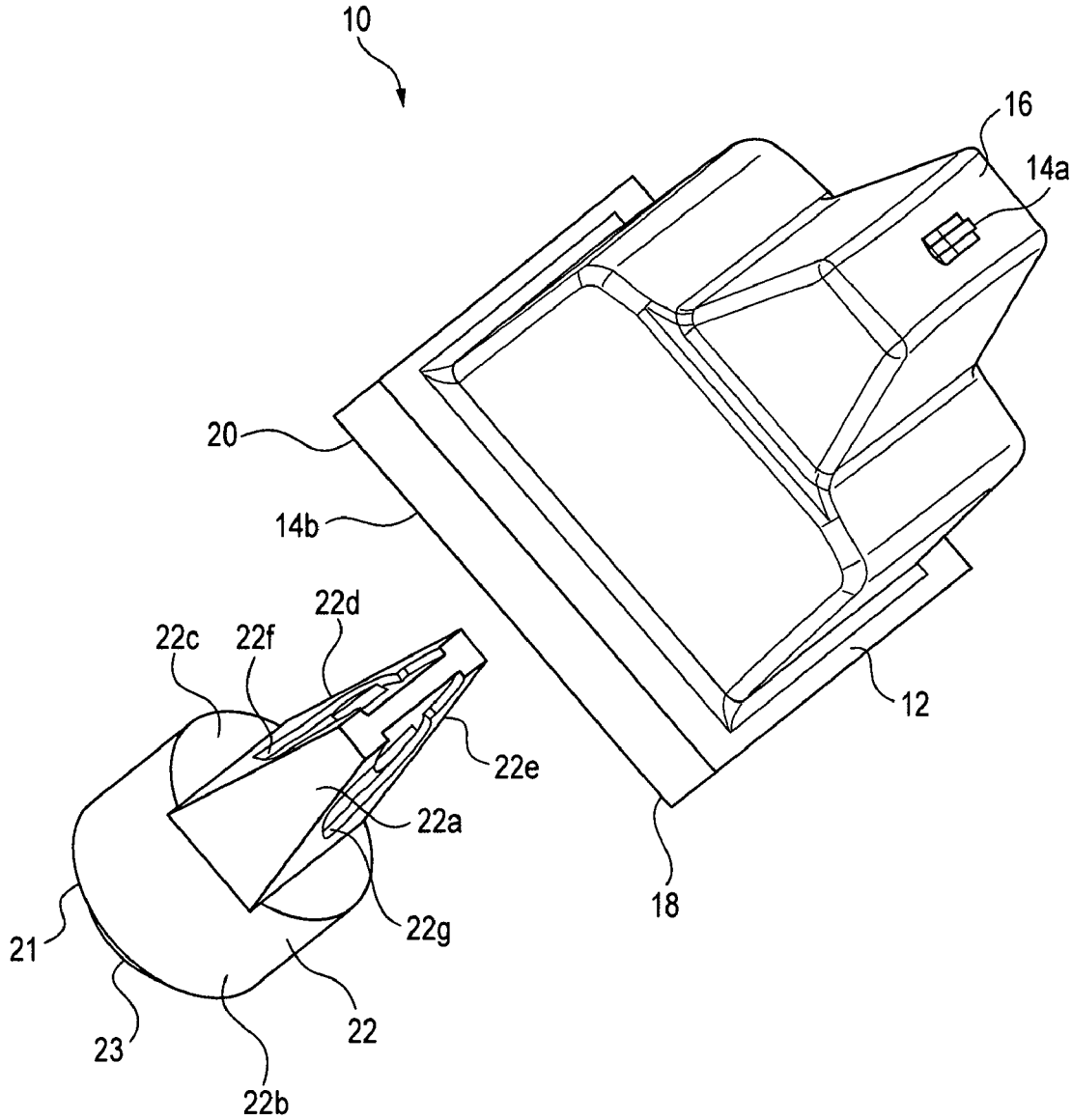
FIG. 19 shows a perspective view of a third preferred embodiment of the present invention in the form of a fluidic nozzle assembly that allows for the "rear-loading" of the fluidic insert.

FIG. 19 shows a perspective view of a third preferred embodiment of the present invention. This embodiment takes the form of a fluidic nozzle assembly 10 that allows for the "rear-loading" of a more complicatedly-designed fluidic insert 22. Such an embodiment has been found to be especially useful in those high-pressure applications in which there is a problem in sealing against leakage the interface surfaces between the fluidic insert's exterior surface and the interior surface of the housing's passage.

This assembly or member 10 again consists of a housing 12 which has a passage 14 that extends along its centerline between its front 16 and rear 18 surfaces. This passage 14 is seen to have a front 14*a* and a rear 14*b* portion in which the front portion of the passage takes the form of an element of the insert's fluidic circuit (i.e., a throat and an expansion section). The passage's rear portion 14*b* is configured into a cavity 20 that allows for the rear-loading, press-fit insertion of the fluidic insert 22.

The more complicatedly-designed insert 22 of this embodiment is seen to have a front 22*a* and a rear 22*b* portion and a wall 22*c* that separates them. Its front portion has a fluidic circuit molded into both its top 22*d* and bottom 22*e* flat-faced surfaces. The upstream portions of both of these circuits connect to an orifice 22*f*, 22*g* which goes through the wall 22*c* and connects with a cavity 21 that is configured into the insert's rear portion 22*b*. As we've seen in earlier embodiments, the shape of this cavity 21 and the insert's rear surface 23, along with possibly the housing's rear surface 18, will usually be configured so as to allow for mating with the front face 2*a* of the spray head onto which the assembly 10 is to be fitted.

It was previously mentioned that these fluidic nozzles for spray applicators will often be called upon to spray substances that include window cleaning solutions, carpet cleaners, other general cleaning products, etc. It was in experimenting with various fluidic circuits to spray such soap-like solutions (i.e., detergent containing) so as to overcome the previously mentioned "streaming problems" that we discovered a somewhat surprising finding—fluidic circuits work very well to spray foams.

This was unexpected since it had previously been found that almost all of the known fluidic circuits could not effectively spray mixtures of liquids and air (two phase flows). This was thought to be the case because the vortices that are typically formed in such circuits to induce oscillations in the sprays are no longer formed with the expected regularity or work as effectively because of the air pockets that exist in such two phase flows. However, we found that when the air is effectively trapped in small amounts throughout the foam that our fluidic circuits behaved as expected.

The technology for creating a foam while spraying a soap-like solution is well known. One creates at a point upstream of the spray nozzle an expansion section in the liquid's flow passage. An orifice is then added in this expansion section which connects with the surrounding atmosphere. This allows the flowing soap-like solution to entrain air through the orifice and this air is then mixed with the solution as it flows downstream so as to create a foam which is then sprayed from the nozzle.

Figure 20:
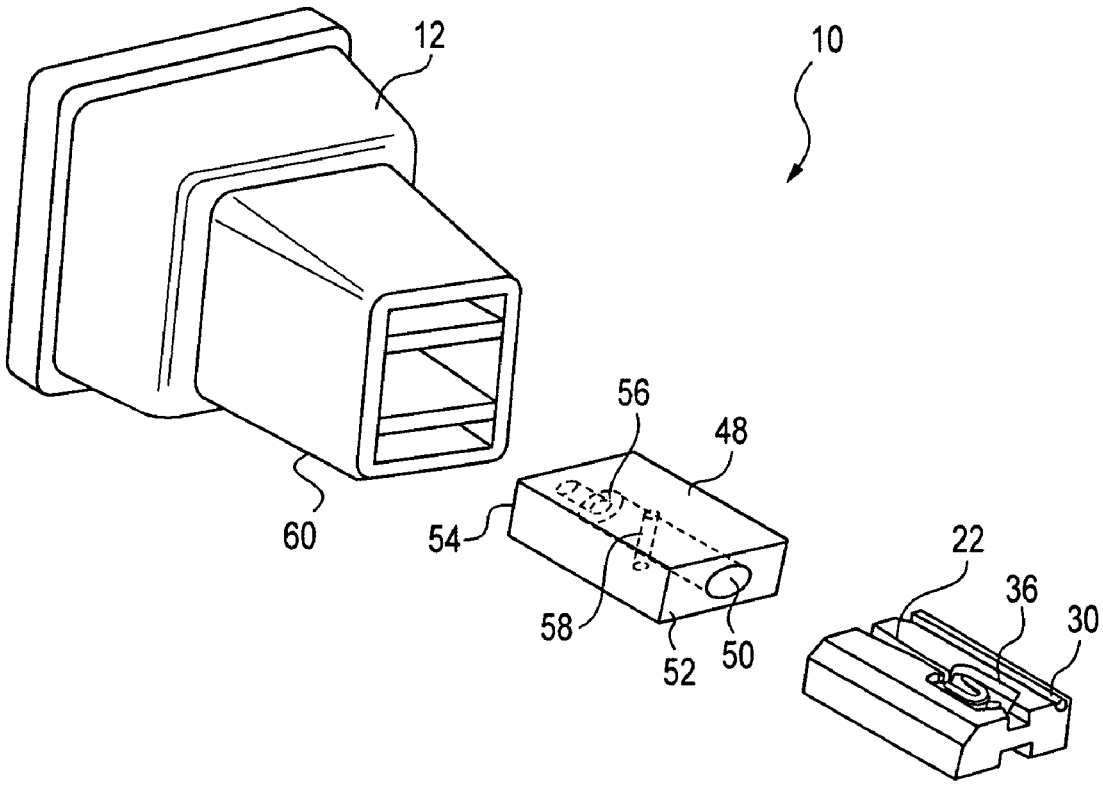
FIG. 20 shows a perspective view of a fourth embodiment of the present invention in the form of a fluidic nozzle that, when used with a soap-like solution, can spray a foam.

Shown in FIG. 20 is a fourth embodiment of the present invention in the form of an assembly 10 that includes a housing, 12, whose rear portion is suitable configured to mate with an applicator spray head, a fluidic insert 22 and what we call an upstream "air engine" 48 that serves to entrain air that is then mixed with the soap-like solution to form a foam which is sprayed into a desired spray pattern by a suitably chosen fluidic circuit 36 that is molded into, in this instance, the insert's top surface 30.

As previously indicated, the air engine 48 has a passage 50 that connects its front 52 and rear 54 faces. At a point in this passage there is an expansion section 56 that provides for a rapid increase in the diameter of the passage. Proximate this section is an orifice 58 that connects this passage with the engine's exterior surface. Aligned with this orifice is a comparable orifice 60 in the housing which connects the cavity in which the engine is situated to the surrounding gaseous atmosphere. These orifices allow a liquid flowing thru the engine to entrain air through the orifices and to subsequently mix it with the liquid that flows thru the assembly 10. When this liquid is a soap-like solution, it mixes with the air to create a foam which is then sprayed from the fluidic insert 22.

It should be recognized that all of the fluidic nozzle embodiments previously shown can, like that shown in FIG. 20, be easily modified by the addition of an air engine 48 upstream of the fluidic circuit so as to, when used with a soap-like solution, spray foam in a wide rage of spray patterns.

Although the foregoing disclosure relates to preferred embodiments of the invention, it is understood that these details have been given for the purposes of clarification only. Various changes and modifications of the invention will be apparent, to one having ordinary skill in the art, without departing from the spirit and scope of the invention as it will eventually be set forth in claims for the present invention.

We claim:

1. A fluidic nozzle for use with a trigger spray applicator that issues a desired spray pattern of liqiuid droplets into a surrounding gaseous environment, said applicator having a spray head with a liquid delivering orifice and an exterior surface proximate said orifice that is configured to receive said nozzle, said fluidic nozzle comprising:

a housing having a front and a rear face and between which passes a housing passage having a front and a rear portion, a fluidic insert having a front and a rear face and between which passes an insert passage that includes a portion configured as a fluidic circuit, said housing passage front portion configured as a cavity that extends from an opening in said housing front face, said cavity configured so as to allow said fluidic insert to be press fitted through said housing front face opening and into said cavity, wherein said fluidic circuit configured so as to aid in providing said desired spray pattern, wherein said spray head having a centerline and said spray head orifice being off said centerline, and said spray head exterior surface configured to receive a nozzle having a circular shape so as to receive a rotatable nozzle, said housing passage having a wall separating said front and rear portions, said wall having a rear face and a front face and an orifice between said wall faces, said orifice situated in said wall so as to be alignable with said spray head off-centerline orifice, said housing passage rear portion configured so as to allow said housing to fit on said spray head configured to receive said rotatable nozzle, said fluidic insert having at least a second passage extending between said faces and in which a portion of said second passage is configured as a fluidic circuit, each of said passages containing said fluidic circuits having an opening in said insert rear face that allows fluid to enter each of said circuits, and said fluidic circuit openings situated in said insert rear face so as to be alternately alignable with said wall orifice as said housing is rotated on said spray head so as to allow a nozzle user to choose which of said fluidic circuits is aligned for said flow of liquid from said applicator.

2. The fluidic nozzle as recited in claim 1, wherein:

said wall rear face further having a groove in the shape of a circular arc segment of a specified number of degrees, said groove having a boundary surface in which is located a second orifice that connects the bottom of said groove and said wall front face, said groove further configured such that one of said fluidic circuit openings can be aligned with said spray head orifice over a specified range of degrees of said groove arc segment.

3. The fluidic nozzle as recited in claim 2, wherein:

said fluidic insert further having a streaming flow passage between said insert faces that provides for flow between said faces which yields a streaming spray pattern, said streaming flow passage having on opening in said insert rear face, wherein said streaming flow passage opening situated in said insert rear face so as to be alternately alignable with said wall orifice as said housing is rotated on said spray head so as to allow a nozzle user to choose to have a streaming spray pattern issue from said applicator.

4. A method for making a fluidic nozzle for use with a trigger spray applicator that issues a desired spray pattern of liquid droplets into a surrounding gaseous environment, said applicator having a spray head with a liquid delivering orifice and an exterior surface proximate said orifice that is configured to receive said nozzle, said method comprising the steps of:

forming a housing having a front and a rear face and between which passes a housing passage having a front and a rear portion, forming a fluidic insert having a front and a rear face and between which passes an insert passage that includes a portion configured as a fluidic circuit, configuring said housing passage front portion as a cavity that extends from an opening in said housing front face, said cavity configured so as to allow said fluidic insert to be press fitted through said housing front face opening and into said cavity, wherein said fluidic circuit configured so as to aid in providing said desired spray pattern wherein said spray head having a centerline and said spray head orifice being off said centerline, and said spray head exterior surface configured to receive a nozzle having a circular shape so as to receive a rotatable nozzle, said housing passage having a wall separating said front and rear portions, said wall having a rear face and a front face and an orifice between said wall faces, said orifice situated in said wall so as to be alignable with said spray head off-centerline orifice, said housing passage rear portion configured so as to allow said housing to fit on said spray head configured to receive said rotatable nozzle, said fluidic insert having at least a second passage extending between said faces and in which a portion of said second passage is configured as a fluidic circuit, each of said passages containing said fluidic circuits having an opening in said insert rear face that allows fluid to enter each of said circuits, said fluidic circuit openings situated in said insert rear face so as to be alternately alignable with said wall orifice as said housing is rotated on said spray head so as to allow a nozzle user to choose which of said fluidic circuits is aligned for said flow of liquid from said applicator.

5. The method as recited in claim 4, wherein:

said wall rear face further having a groove in the shape of a circular arc segment of a specified number of degrees, said groove having a boundary surface in which is located a second orifice that connects the bottom of said groove and said wall front face, said groove further configured such that one of said fluidic circuit openings can be aligned with said spray head orifice over a specified range of degrees of said groove arc segment.

6. The method as recited in claim 5, wherein:

said fluidic insert further having a streaming flow passage between said insert faces that provides for flow between said faces which yields a streaming spray pattern, said streaming flow passage having on opening in said insert rear face, wherein said streaming flow passage opening situated in said insert rear face so as to be alternately alignable with said wall orifice as said housing is rotated on said spray head so as to allow a nozzle user to choose to have a streaming spray pattern issue from said applicator.

* * * * *